US006461254B1

(12) United States Patent
Ballett et al.

(10) Patent No.: US 6,461,254 B1
(45) Date of Patent: Oct. 8, 2002

(54) GOLF BALL AND TEE SETTING DEVICE

(76) Inventors: Bruce Ballett, 1803 3rd Street Louth, St Catharines, Ontario (CA), L2R 6P9; Osman Tahirovic, 1787 3rd Street Louth, St Catherines Ont (CA), L2R 6P9; Harold Whittaker, 200 Creek Road, St. Davids Ont (CA), L0S 1P0

( * ) Notice: Subject to any disclaimer, the term of this patent is extended or adjusted under 35 U.S.C. 154(b) by 0 days.

(21) Appl. No.: 09/571,159

(22) Filed: May 16, 2000

(51) Int. Cl.[7] ..... A63B 57/00
(52) U.S. Cl. ..... 473/386
(58) Field of Search ..... 473/386, 132

(56) References Cited

U.S. PATENT DOCUMENTS

| | | | | | |
|---|---|---|---|---|---|
| 2,609,198 | A | * | 9/1952 | Armstrong | 473/386 X |
| 4,526,369 | A | * | 7/1985 | Phelps | 473/386 X |
| 4,589,661 | A | * | 5/1986 | Attig | 473/386 X |
| 4,969,646 | A | * | 11/1990 | Tobias | 473/386 X |
| 5,330,178 | A | * | 7/1994 | Geishert, Sr. | 473/386 |
| 5,499,813 | A | * | 3/1996 | Black | 473/386 |
| 5,503,394 | A | * | 4/1996 | Mauck et al | 473/386 |
| 5,540,432 | A | | 7/1996 | Keller | |
| 5,624,333 | A | | 4/1997 | Dayton | |
| 5,632,696 | A | | 5/1997 | Nichols et al. | |
| 5,645,498 | A | | 7/1997 | Cretella | |
| 5,672,121 | A | | 9/1997 | Miller | |
| 5,707,303 | A | | 1/1998 | Berkowitz et al. | |
| 5,759,117 | A | | 6/1998 | Erickson, Jr. | |
| 5,772,533 | A | | 6/1998 | Dahlmann | |
| 5,839,972 | A | | 11/1998 | Swanson | |
| 6,004,227 | A | | 12/1999 | Petersen | |

* cited by examiner

*Primary Examiner*—Raleigh W. Chiu
(74) *Attorney, Agent, or Firm*—Edward H. Oldham

(57) ABSTRACT

A golfing aid for golfers who are unable to stoop which allows a golfer to insert a golf ball and tee into the aid in a contacting relationship so that the tee protrudes from the base of the aid a preset distance. The aid has an elongated handle to allow the ball and tee to be pushed into position so that the tee penetrates the ground while the ball is captively held in contact with the tee. The handle is next released and contact with the ball ceases so that the aid may be removed from the ball and tee without dislodging the ball from the tee.

10 Claims, 5 Drawing Sheets

50
58
60
18
62
66
52
56
16
68
64
54
100
22
20
24
14
36
40
28
102
12
"d"

FIG. 9.
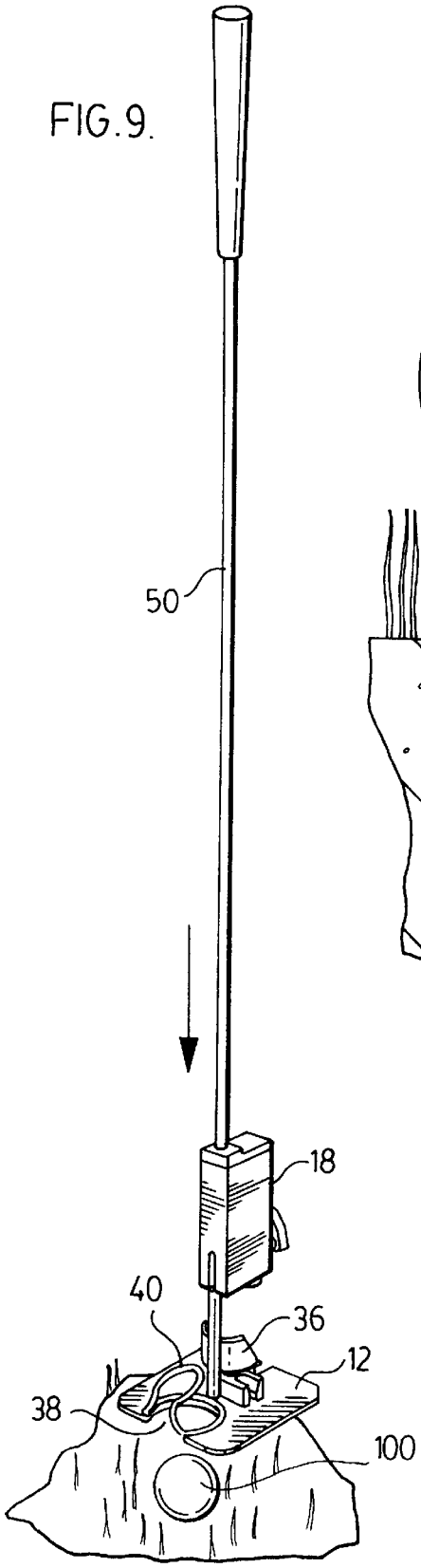
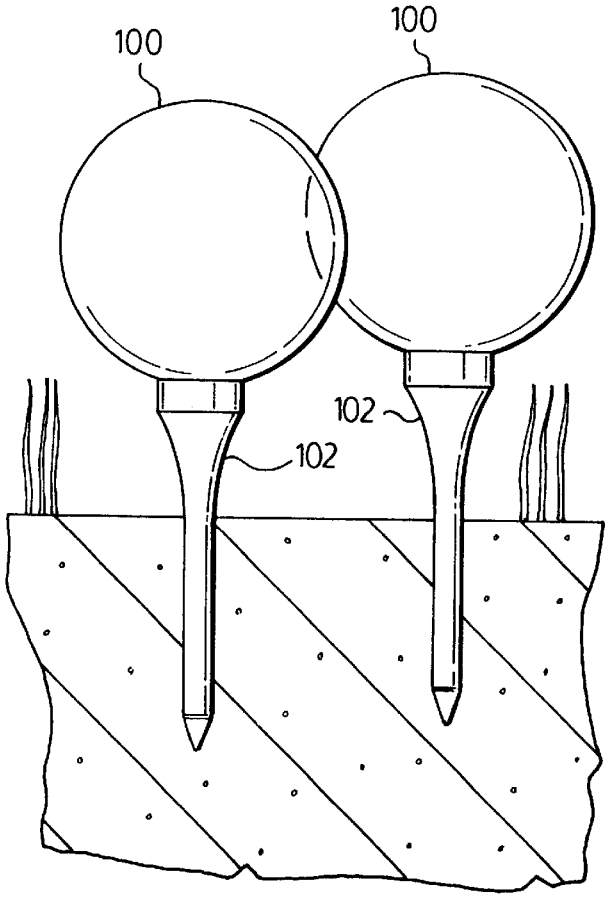
FIG. 10

GOLF BALL AND TEE SETTING DEVICE

BACKGROUND OF THE INVENTION

The game of golf is enjoyed by a large segment of today's population and as the population ages, more and more persons continue to enjoy participation in the sport even when frail or infirm. Devices which allow those persons whose wish it is to continue to participate in golfing and make it possible for them to continue to play in spite of increasing immobility have been in existence for some time. One of the tasks which becomes troublesome to persons who have lost the ability to bend or stoop, is the act of teeing up a golf ball on the turf. The prior art includes many devices which enable handicapped golfers to tee up a ball without stooping.

Generally, most of the prior art devices have a deficiency associated with their operation that hinders universal acceptance of the device. For instance, the tee placement device must be compact enough to fit in a golfer's club bag and if the device bears a resemblance to a golf club the device stands a better chance of being accepted by the golfing fraternity.

The device should be capable of standing independently, that is after the teed up ball has been set up on the turf of the driving tee, the device must be capable of standing by itself on turf so that it may be retrieved by the handicapped golfer (without bending over) after the teed up ball has been driven. If the golfer is required to bend to retrieve the ball-tee placement device after driving the ball, the device may be judged to have achieved a failure rating.

Similarly, if by some misfortune, the golf ball is accidentally dislodged from its position on top of the placed tee, both the ball and tee must somehow be retrieved by the handicapped person (using the prior art device) in order to reassemble the ball and tee in the prior art device. Most of the prior art devices are lacking the ability to recover a ball and tee lying on the turf.

Thus the prior art is replete with a wide variety of devices which in one way or another tend to fall short in their performance when required to fulfill their promise. Failure of the device to perform does little to build confidence in the handicapped or infirm golfer who is desirous of being included in the golfing fraternity in spite of a severe disability.

SUMMARY OF THE INVENTION

This invention comprises a golfing aid which is capable of teeing up a golf ball on the turf of a driving tee of a golf course without requiring the golfer to bend to set the ball-on-tee on the turf. The aid is further capable of retrieving a "loose" golf ball which has been inadvertently dropped to the ground by the golfer or is somehow dislodged from the tee by some misfortune before being driven. The aid may also be used by the handicapped golfer to retrieve the tee whilst it is positioned in the turf after the previously positioned golf ball has been driven. Both these tasks may be accomplished without requiring the golfer to bend or stoop.

The device is provided with a flat foot in order that the handle of the device stays in an upright position when the device is set down on the turf of the driving tee when a ball-tee positioning operation has been completed. The handle of the device may then be conveniently grasped by the handicapped golfer after driving the ball, and the tee may be easily extracted from the ground using the device.

PERTINENT PRIOR ART

U.S. Pat. No. 6,004,227 Dec. 21, 1999

This device which uses a cage to capture a golf ball is capable of retrieving a golf ball from a water hazard on a golf course. It uses a cup like device to center the ball within the cage, in such a manner that the cup biases the ball against the tee in a ball-tee setting operation. The operation of the device as a ball-tee placement device is precarious at the best of times because of the lack of locating means surrounding the ball whilst in its tee engaging position. This device whilst having excellent ball retrieving capabilities (especially in water) is not self standing and its ability to capture a tee is open to question. There is no adjustment possible to vary the height of a teed-up ball.

U.S. Pat. No. 5,839,972 Nov. 24, 1998

This device which may be stored in a golfer's pocket or clipped to his belt, fastens on the end of a golf club when in use. During use the device uses a threaded plunger to engage the golf ball and thrust it against a captive tee. The ball and tee are placed on the driving tee and the plunger is retracted by unscrewing the plunger to a backed off position. Note that this device has a ball and tee retrieval capability, and the device is said to be capable of retrieving a putted golf ball from a cup. This device is not an independent self standing device, and the height of the teed up golf ball is at best done by an educated guess.

U.S. Pat. No. 5,772,533 Jun. 30, 1998

This device is especially interesting because it is compact; it fits on the end of a driver and clips to a golf bag or golfer's belt when not in use. The device utilizes a foam material (commonly used in ear plugs) to hold a "loaded" golf ball and tee in the device. Because of the foam material's peculiar behavioral delay in recovering its shape after being physically distorted, it is compressed during a ball teeing up operation and remains compressed (and retracted from the ball) to allow the golfer to remove the device from the teed up golf ball. The main disadvantage of this device lies in the failure of the foam material to perform its normal function when saturated with water. Other short comings are the lack of any depth control in placing a ball on a tee, and the "tight" dimensional confinement of a golf ball in the device which can cause dislodgment of the golf ball from the tee as the device is being removed from a teed up ball. There appears to be no adjustment on tee height.

U.S. Pat. No. 5,759,117 Jun. 2, 1998

This device utilizes an auxiliary depressible knob on the end of a shaft to actuate a ball captivating device on the other end of the shaft. The ball is set on a tee in the device with a cap locking ball and tee in place in the device. The ball and tee are placed in the turf and the knob releases the cap and the device may be removed. The disadvantages of this device are the lack of stability of device when not in use, and the lack of any positive adjustment on tee height. It is not seen how the device may easily retrieve a golf ball from the turf.

U.S. Pat. No. 5,707,303 Jan. 13, 1998

This device is intended to function as a cane and a golf ball teeing device. The device is capable of gripping and holding a golf ball and tee in position for subsequent placement in the turf of a driving tee. The ball and tee gripping members may be unlocked once the tee and ball are placed in the turf. The gripping members may be then actuated to form a weight bearing surface to function as a cane. There is no provision for tee height adjustment, no means to retrieve a dropped ball or a tee set in the ground. The device is not capable of standing by itself after use.

U.S. Pat. No. 5,672,121 Sep. 30, 1997

This is a "clam shell" device which is spring loaded to hold a golf ball and tee captive therebetween during a ball and tee placement operation. The "clam shells" are retracted to release ball and tee once a teeing position is reached. The device is useful for retrieving dropped balls and may also be useful in retrieving placed tees. No height adjustment appears to be available for the ball on tee during a placement operation. The device is not self standing.

U.S. Pat. No. 5,645,498 Jul. 8, 1997

This device places a tee and ball separately and is capable of retrieving both golf balls and tees separately. No adjustment of tee height is given, and the device is not self standing.

U.S. Pat. No. 5,632,696 May 27, 1997

This is a cane like device which captures a golf ball and tee for placement in the turf. The ball and tee are pressed into the turf for driving and the gripping mechanism is retracted allowing the device to be lifted. This device has no tee height adjustment, and questionable ball retrieval capability.

U.S. Pat. No. 5,624,333 Apr. 29, 1997

This device uses a separate tee setting and ball placing apparatus. The tee is placed and the ball is placed on the tee.

The support rod and tee support member are rotated while the ball positioning member remains engaged with the ball. The ball positioning member is lifted upwardly to disengage the ball. No ball retrieval capability is foreseen and the device is not self standing.

U.S. Pat. No. 5,540,432 Jul. 30 1996

This is a "handle bar" golf tee and ball setter. The tee is set first in the ground and a pair of ball holding pincers are used to place the ball on the tee. This device is capable of retrieving both ball and tee. No depth control is provided for the tee, and the device is not self standing.

BRIEF DESCRIPTION OF THE DRAWINGS

FIG. 9 shows the device being used to retrieve a golf ball.

FIG. 10 shows the difference in elevation obtainable by the use of separate tee receptacles.

DESCRIPTION OF THE PREFERRED EMBODIMENT

Figure 2:
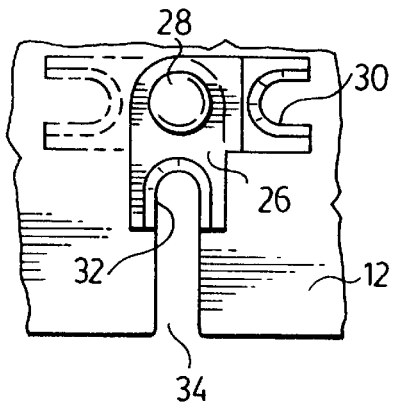
FIG. 2 shows a section of the base of the device of FIG. 1 showing the pivotable tee holder.
Figure 1:
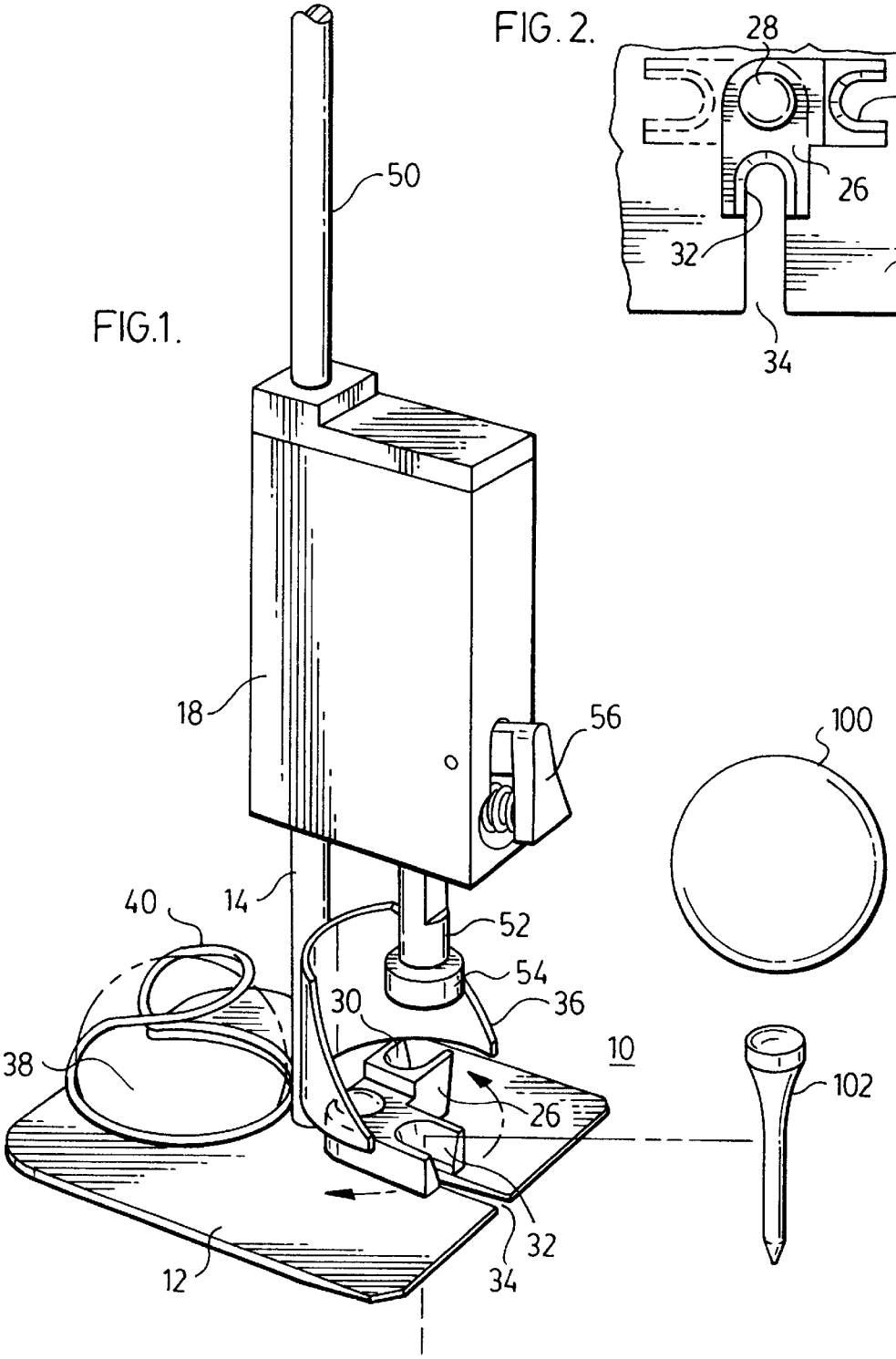
FIG. 1 is a perspective view of the device of this invention.

Referring now to FIGS. 1, 2, 3 and 4 a golf ball teeing device 10 is shown having a base 12 on which a shaft 14 is mounted. Upstanding shaft 14 is slidably received into bore 16 of housing 18. Housing 18 is mounted on shaft 14 so as to be permitted to move in a plane in the vertical direction only and is spring loaded to be biased to a maximum distance away from base 12. A spring 20 mounted in cavity 22 presses on head 24 of shaft 14.

Also mounted on base 12 is a pivoting boss 26 for receiving a golf tee. Boss 26 is mounted on base 12 so as to be pivotal about pin 28.

Boss 26 is provided with two receptacles, 30, 32 for receiving a golf tee therein. Receptacle 30 has a greater top surface elevation than receptacle 32 and thus provides a means for teeing up a golf ball at greater elevation than receptacle 32. The adjustable tee height is a useful feature because most golfers wish to tee a golf ball slightly higher when driving a golf ball with a "wood" than when driving with an "iron".

An open slot 34 in base 12 is directly in alignment with the receptacle 32 of boss 26. A ball shield 36 is mounted on shaft 14 to provide a golfer with a guide for assisting in the proper placement of a golf ball in the device 10.

Besides proving a suitable confinement for shaft 14, housing 18 provides a facility for receiving shaft 52 therein in a sliding relationship. Shaft 52 is restrained from twisting and is provided with a ball engaging head 54 having a concave lower surface to assure good ball retention capability.

Shaft 52 is housed in bore 60 of housing 18 and is supplied with enlargement 62 at the end opposite head 54. A spring 58 supplies the shaft 52 and head 54 with a constant downward force, so that head 54 is always urged toward base 12.

A cam stopper 56 is pivotally mounted on housing 18 by pivot 66 to hold shaft 52 in its retracted position in housing 18 against the force of spring 58. Cam stopper 56 is held in its camming position against flat 68 of shaft 52 by spring 64.

A handle 50 (similar to a golf club shaft) is fixedly attached to housing 18.

At the rear of base 12 is an opening 38 around which a resilient loop of wire 40 is mounted to form a golf ball capturing cage. This cage allows a physically disabled person to retrieve a golf ball from the fairway etc.

Figures 3, 4:
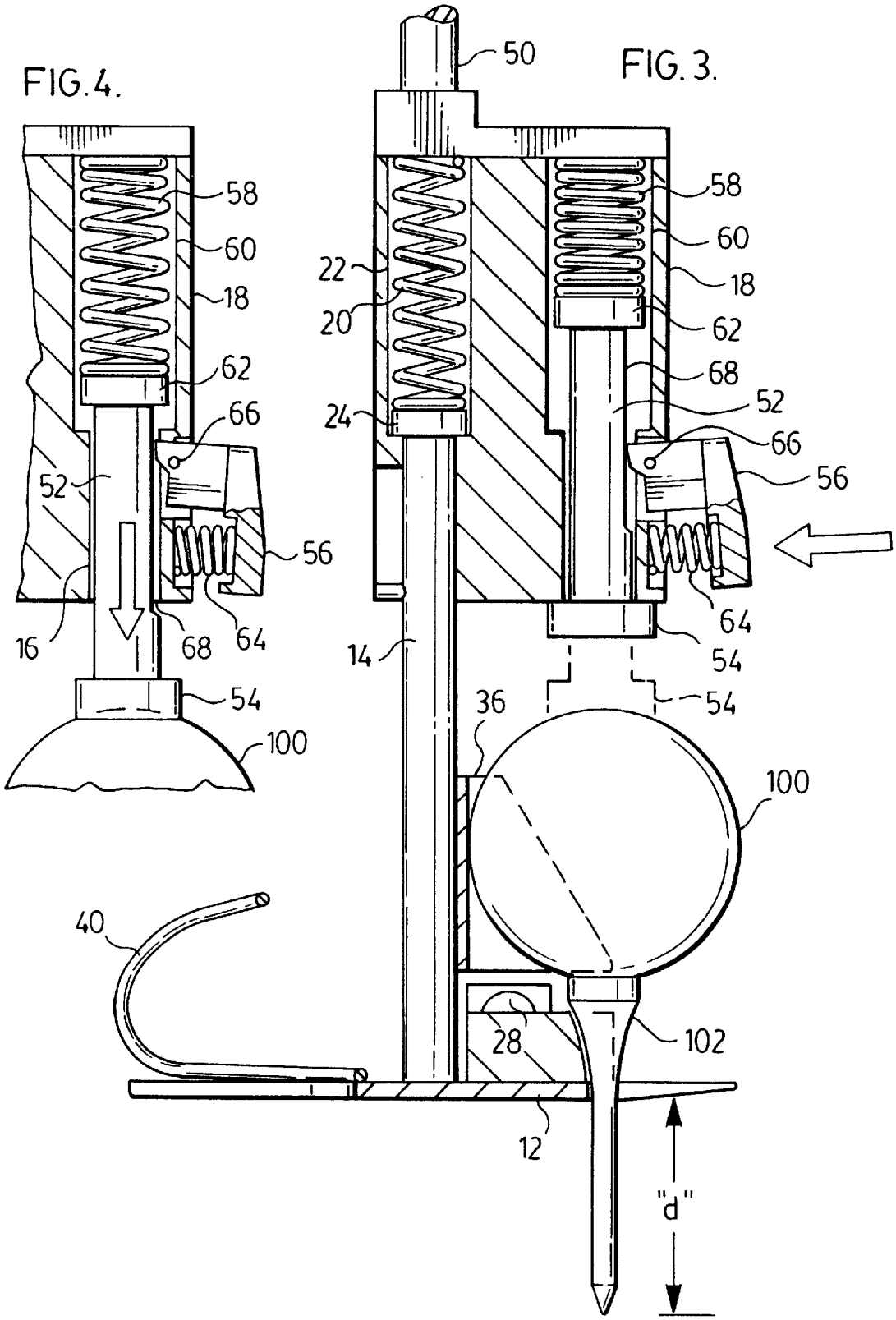
FIG. 3 shows a view of the device of this invention where the golf ball and tee have been inserted in the device.
FIG. 4 is a partial view of the device with the golf ball restraining device in position.

In operation, a tee is slid into slot 34 of base 12 until it is embraced by receptacle 32 of boss 26 (see FIG. 3). A golf ball is placed in the ball shield 36 and on the tee inserted previously in receptacle 32. Cain 56 is pushed (as shown by the arrow in FIG. 3), releasing shaft 52 to push ball clamping head 54 downwardly against the ball (and tee) so that the ball and tee are firmly held against receptacle 32 in boss 26. At this time the tee protrudes a "set" distance "d" below base 12. FIG. 4 shows the device 10 with the ball engaging head 54 in contact with ball 100.

Figure 5:
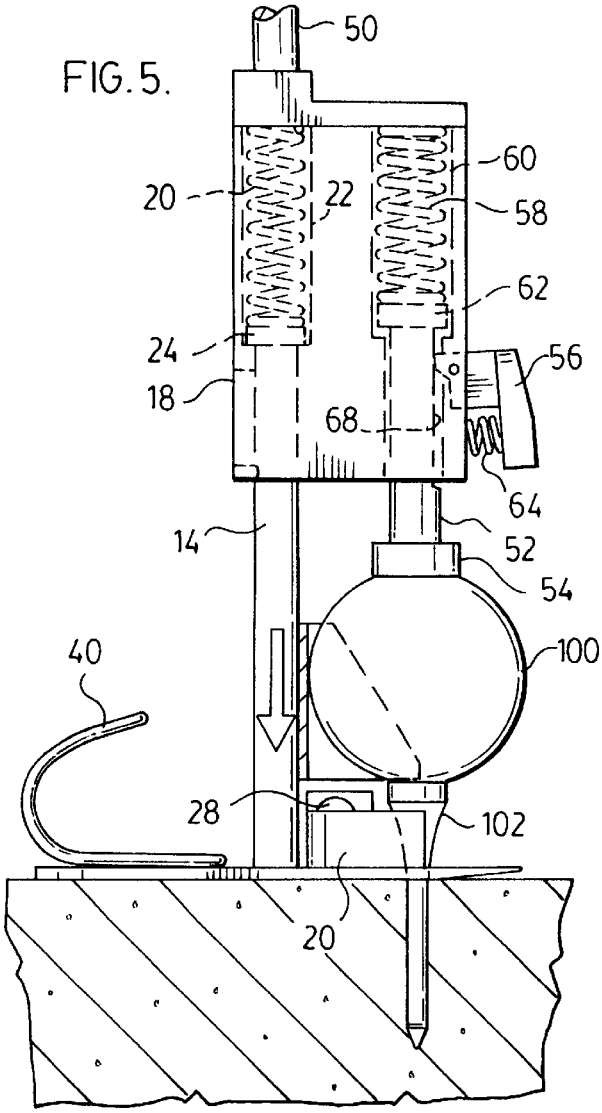
FIG. 5 shows the device with golf ball and tee loaded being pressed into the ground.
Figure 6:
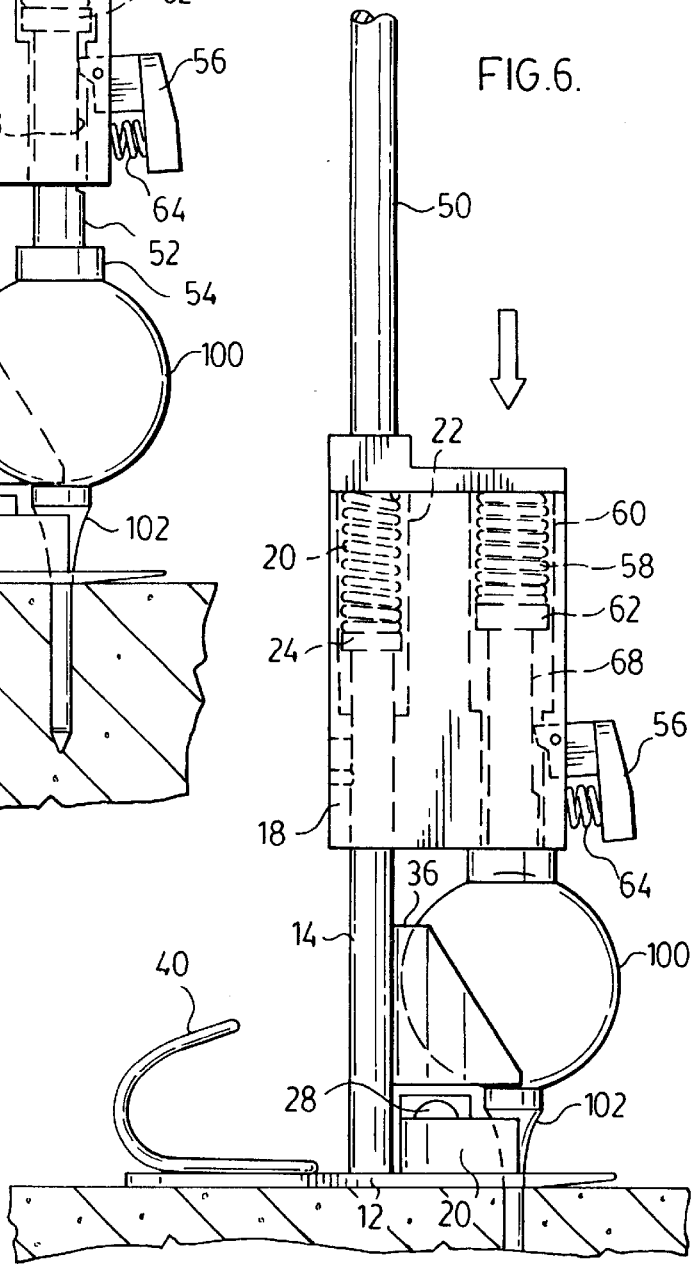
FIG. 6 illustrates the final position of the ball and tee setting device which "sets" the ball and tee in the ground.
Figure 7:
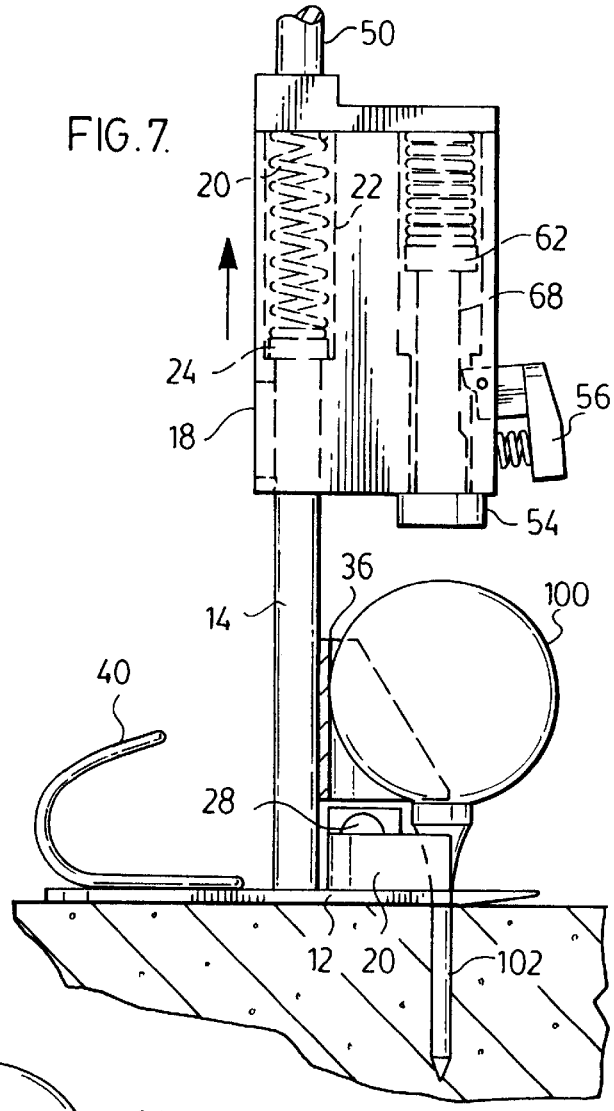
FIG. 7 shows the device with the ball restraint in the released position.
Figure 8:
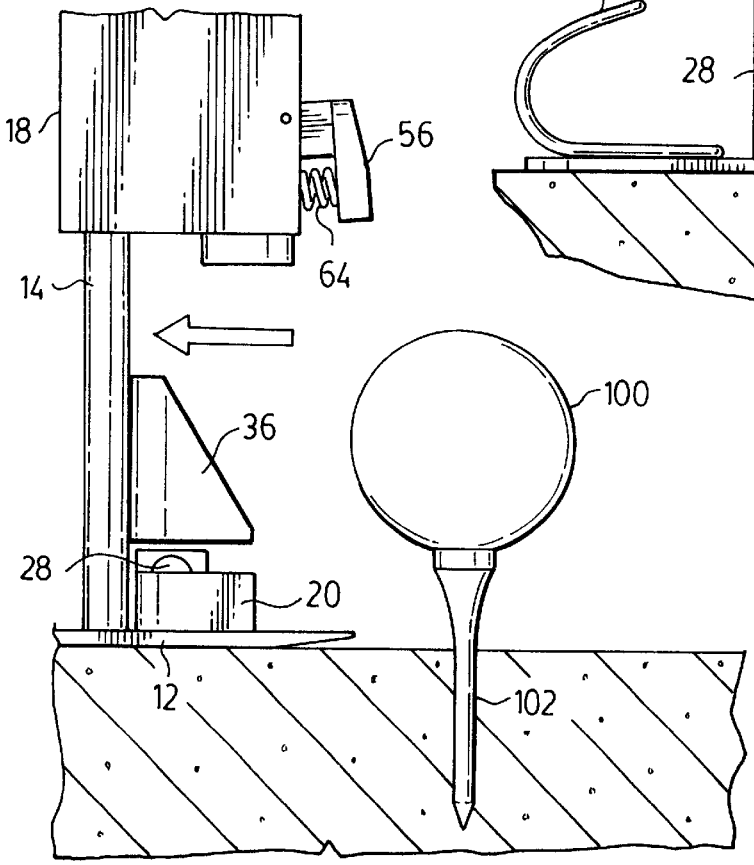
FIG. 8 shows the device being removed from the set golf ball and tee.

The device 10 is then placed on the turf of the driving tee (see FIG. 5) and handle 50 is pressed downwardly (see FIG. 6). The housing 18 slides downwardly on shaft 14 compressing spring 20. Simultaneously shaft 52 on which the ball restraining head 54 is mounted, retracts into housing 18 compressing spring 58. Spring 58 supplies a constant force on the ball and tee to keep them in engagement with tee receptacle 32 in boss 20 as the tee is being pushed into the turf. Spring 58 possesses sufficient strength to hold the ball and tee in engagement with receptacle 32 during a ball teeing operation. When the housing 18 has reached the end of its travel downwardly, the ball and tee are deemed to be "set" and the golfer who had been previously pushing down on shaft 50 and housing 18 now releases the downward pressure and housing 18 is allowed to rise to its "rest" position. Head 54 is now held in its retracted position by cam 56 and the head 54 will now be retracted a predetermined distance from the teed up ball as housing 18 rises (see FIG. 7). Device 10 may now be slid away from the teed up ball by means of open slot 34 (see FIG. 8).

If the ball is desired to be teed to a higher height boss 26 is twisted through a right angle to align receptacle 30 with slot 34 in base 12. The ball 100 and tee 102 will now be set at a higher height then previously.

Besides allowing the device 10 to be removed from a teed up ball, slot 34 provides a tee retrieving receptacle for device 10 so that a golfer can retrieve his tee using slot 34 after driving a ball.

If perchance a golfer drops his ball or a club and cannot stoop to retrieve it, the receptacle formed by wire cage 40 will capture a loose ball (see FIG. 9) and the projecting portion of foot 12 may be used to pick up a club lying on the turf.

This device is therefore capable of accurately setting a golf ball up on a tee at a number of different heights depending on the number of receptacles formed in boss 26 (see FIG. 10). The ball is always positively set at the same height above the turf if the same receptacle is used in boss 26. Shield 36 provides for quick and accurate placement of the golf ball in the device during a teeing operation.

This device will be found to be "golfer friendly" in that recovery of golf ball, tee and club are possible should a handicapped golfer drop his/her ball, tee or club during a ball teeing operation.

The ball is accurately set in the turf for each setting of boss 26 with no guess work required.

The device is quite capable of independently standing by itself on the turf while a golfer drives his teed up ball.

Thus it is seen that this particular golfing aid may be "loaded" with golf ball and tee while the shaft 50 is in any orientation, shield 36 serves as a convenient guide to assure proper placement and alignment with ball and tee regardless of position.

Boss 26 is illustrated here as having 2 different heights available for setting the golf ball. Of course the boss 26 may be modified to provide more tee heights if desired.

The golfing aid described herein is capable of allowing a golfer who is physically challenged to continue to play golf in an independent manner.

Although variations in the device will be obvious to persons skilled in this art, the applicants prefer to have the ambit of protection defined in the following claims.

What is claimed:

1. A golfing aid for golfers who are unable to bend comprising a housing for a retractable head for holding a golf ball against a tee in said aid in such a manner that said tee protrudes a predetermined distance from said aid, a handle for said aid to permit a golfer to depress said housing and urge a golf ball against said tee downwardly so as to penetrate into a suitable turf said predetermined distance whilst simultaneously causing said head to retract into said housing, check means on said housing to hold said ball head in a retracted position, bias means associated with said housing for urging said housing and said retracted head away from said ball and tee when said handle is released.

2. A golfing aid as claimed in claim 1 wherein said distance is adjustable.

3. A golfing aid as claimed in claim 2 wherein said aid is provided with a suitable foot to permit said aid to stand alone on said turf with said handle upright.

4. A golfing aid as claimed in claim 3 wherein said aid is supplied with cage mans for capturing a golf ball on said turf.

5. A golfing aid as claimed in claim 4 which includes a tee retrieving device.

6. A golf ball and tee placement and setting device comprising a platform having a tee embracing device formed thereon at the end of an open slot formed in said platform, a ball engaging device in the form of a retractable head mounted above said tee embracing device for holding a golf ball against a tee in said tee embracing device, said ball engaging device being captive in a housing supported by said platform, said ball engaging device having a bias means for urging said golf ball against said tee, said ball engaging device being capable of resistibly retracting during a ball and tee settling operation, check means for holding said ball engaging means in its retracted position after a ball and tee have been placed and set, said housing being movable in a plane orthogonal to said platform to permit motion toward and away from said tee embracing device, said housing being biased in a direction away from said platform.

7. A golf ball and tee placement and setting device as claimed in claim 6 wherein an upwardly extending handle is supported on said housing.

8. A golf ball and tee placement and setting device as claimed in claim 7 wherein said tee embracing device is capable of supporting and embracing golf tees at a plurality of elevations above said platform.

9. A golf ball and tee placement and setting device as claimed in claim 8 wherein said platform is provided with golf ball capturing means on said platform.

10. A golfing aid for holding a golf ball and tee in contact in such an attitude that a golfer can tee up a golf ball in turf without stooping, said aid comprising a tee embracing means for releasably holding a tee in said aid so that said tee protrudes downwardly a predetermined distance from a reference plane in said aid, golf ball restraining means for releasably holding said golf ball in contact with said tee, handle means on said aid for pressing said golf ball and tee into the turf a predetermined distance, release means associated with said golf ball restraining means to permit said ball restraining means to retract from said ball when said handle is released, escape means on said aid to permit said aid to be removed from said ball and tee with said handle in the released position.

* * * * *